United States Patent [19]

Whyte

[11] 3,971,504

[45] July 27, 1976

[54] BANDED CARTON AND BLANK ASSEMBLY

[75] Inventor: Adrian Alan Whyte, Bardonia, N.Y.

[73] Assignee: Schenley Industries, Inc., New York, N.Y.

[22] Filed: June 6, 1975

[21] Appl. No.: 584,311

Related U.S. Application Data

[62] Division of Ser. No. 447,434, March 1, 1974, Pat. No. 3,911,798.

[52] U.S. Cl. ..... 229/38; 229/87 R; 40/312

[51] Int. Cl.[2] ..... B65D 5/10

[58] Field of Search ..... 229/38, 37, 87 R; 40/312; 206/457

[56] References Cited

UNITED STATES PATENTS

| | | | |
|---|---|---|---|
| 3,335,937 | 8/1967 | Kramer | 229/38 |
| 3,335,938 | 8/1967 | Kramer | 229/38 |
| 3,424,367 | 1/1969 | Desmond et al. | 229/38 |
| 3,534,898 | 10/1970 | Manizza | 229/38 |
| 3,729,126 | 4/1973 | Donahue | 229/38 |

*Primary Examiner*—Davis T. Moorhead

*Attorney, Agent, or Firm*—Blum, Moscovitz, Friedman & Kaplan

[57] ABSTRACT

This disclosure relates to a carton which has a decorative appearance of a nature so as to form a satisfactory gift package without further wrapping and wherein the carton is provided with a removable identification sleeve. The sleeve is preferably formed of a transparent material and the connection thereof to an exposed surface of the carton is provided with a removable identification sleeve.

1 Claim, 6 Drawing Figures

FIG. 1
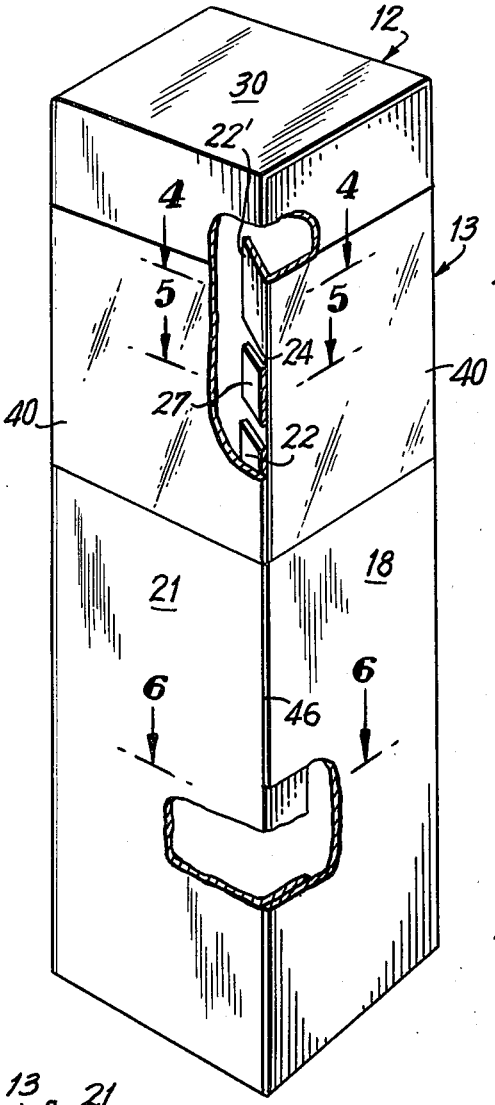
FIG. 2
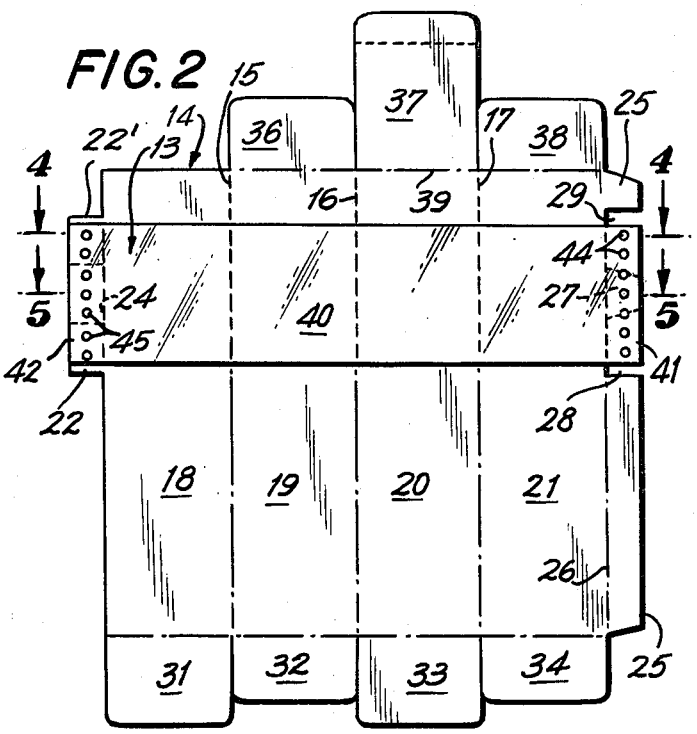
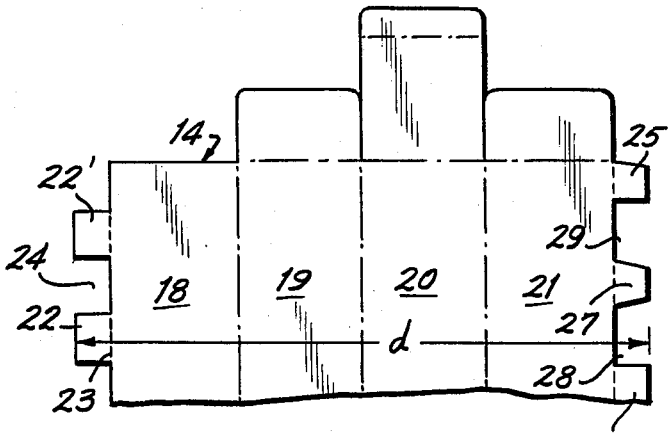
FIG. 3
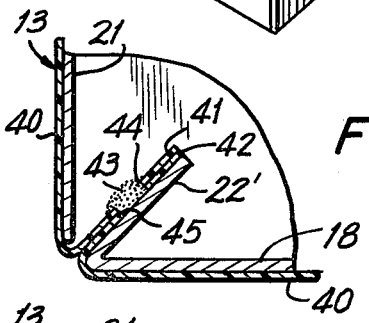
FIG. 4
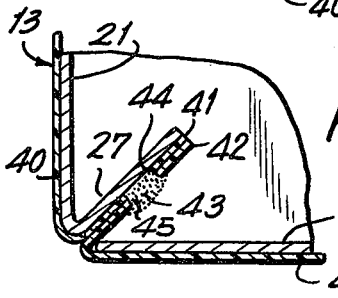
FIG. 5
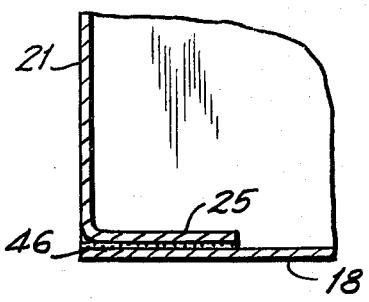
FIG. 6

BANDED CARTON AND BLANK ASSEMBLY

This is a division of application Ser. No. 447,434, filed Mar. 1, 1974 now U.S. Pat No. 3,911,798 issued Oct. 14, 1975.

BACKGROUND OF THE INVENTION

This invention generally relates to a method for sealing an identification band to a gift carton in which a product may be readily packaged in a conventional manner. In particular, this invention relates to a method for sealing ends of an identification band to selected areas of a carton blank for providing fixed blank to band and band to band seals in the carton erected therefrom, a novel carton blank embodiment to which the method is particularly applicable and the carton erected therefrom.

It is known in the art to provide gift package cartons with removable identification bands carrying printed indicia rather than printing the advertising indicia directly on the carton. When these identification bands are employed, they have been secured to carton ends rather than body panels thereof, so that the gift giver can remove the band without defacing the carton. The cartons to which these bands have been secured are generally provided with a single body seam. However, according to prior band attachment methods, the body seam of the carton has separated during handling or one end of the band or the other has tended to detach from its securement position.

Therefore, a need has developed for permanently affixing ends of the identification band to a carton, until it is desired that the band be removed, i.e., manually removed. Moreover, the need has also developed for a carton embodiment wherein the body seam remains secure, although the carton is subjected to substantial handling in transit.

SUMMARY OF THE INVENTION

Generally speaking, in accordance with the invention, there is provided a method for sealing ends of an identification band to selected areas of a carton blank for thereby providing fixed blank to blank and band to band seals in the carton erected from said blank and a novel carton blank embodiment to which the method is particularly applicable, and the carton erected therefrom.

In general, the method is applicable to a generally rectangular blank having score and cut lines formed therein and defining a plurality of centrally located and adjacent body panels having end forming flaps at opposite ends thereof, and at least one glue flap or tab along one of the body panels. The method comprises serially perforating the identification band along predetermined margins thereof selectively spaced from opposed ends of the identification band, the perforations being longitudinally arranged on each margin of the band and respective series of the perforations located in the margins proximate opposed ends of the band being substantially parallel, extending the identification band transversely across the body panels of the carton blank in overlying relationship to the outer surface thereof, applying glue to the at least one glue flap or tab provided along one of the body panels of the carton blank, affixing a perforated margin of an end of the identification band to the glue flap or tab so as to permit glue applied thereon to leak through the perforations arranged on the identification band margin, adhesively affixing the other perforated margin of the identification band to the carton blank so as to permit the adhesive to leak through the perforations provided in the margin of the other end of the identification band, the affixed identification band being transversely located across said outer surface of the body panels of the carton blank and being free from the body panels thereof, and erecting the carton blank with the affixed identification band to form a carton therefrom with the opposed perforated margins of the identification band being in face to face adhesive engagement.

While an identification band may be satisfactorily secured to any gift carton constructed from a blank of the generally rectangular type described according to the method, it is preferred that the method be employed in connection with a particular novel blank embodiment. The novel carton blank embodiment comprises a generally rectangular sheet having score and cut lines therein defining a plurality of adjacent body panels having end forming flaps at opposite ends thereof, a glue flap along one of the body panels, a tab defined in the glue flap, a pair of tabs along another of the body panels, a slot in the other body panel determined by the pair of tabs, and that slot is axially aligned with the tab provided in the glue flap. An identification band extends transversely across the body panels in overlying relation to the outer surface thereof. The identification band has opposed ends and in margins thereof located a predetermined distance from the respective opposed ends, respective series of longitudinal perforations are provided. One of the opposed ends of the identification band is adhesively secured to the pair of tabs along the margin of the identification band. The other end of the identification band is adhesively secured to the tab provided in the glue flap along the margin of the identification band. The identification band is otherwise free from the body panels of the carton blank.

A novel carton embodiment may be erected from the banded blank which includes a body seam at one corner of the carton. The body seam includes the tab provided in the carton blank glue flap and the perforated identification band end secured thereto. An adhesive secures the outer face of that perforated band margin to the perforated outer face of the band margin secured to the pair of tabs provided along the other body panel. The adhesively bonded tabs and band margins are disposed within the erected carton.

Accordingly, it is an object of this invention to provide a method for permanently securing ends of an identification band to selected areas of a carton blank and providing fixed blank to blank and band to band seals in the carton erected therefrom.

Another object of the invention is to provide a method for substantially permanently securing an identification band to a gift carton until it is desired that the band be physically removed therefrom.

A further object of the invention is to provide a method for sealing an identification band to a gift carton provided with a body seam which does not separate, although the carton is subjected to substantial handling in transit.

Still another object of the invention is to provide a carton blank embodiment to which the sealing method is particularly applicable.

Another object of the invention is to provide a banded carton erected from the novel carton blank with a secure body seam and affixed identification band.

Still other objects and advantages of the invention will, in part, be obvious and will, in part, be apparent from the specification.

The invention accordingly comprises the several steps and the relation of one or more of such steps with respect to each of the others, the novel carton blank embodiment, combinations and arrangement of parts which are adapted to effect such steps, and the assembled carton which possesses the characteristics, properties and relation of elements, all as exemplified in the detailed disclosure hereinafter set forth and the scope of the invention will be indicated in the claims.

BRIEF DESCRIPTION OF THE DRAWINGS

For a fuller understanding of the invention, reference is had to the following description taken in connection with the accompanying drawings in which:

FIG. 1 is an isometric view of a banded carton erected from the novel carton blank having an identification band sealed thereto according to the method of the invention;

FIG. 2 is a plan view of the novel carton blank having an identification band sealed thereto in accordance with the invention;

FIG. 3 is a fragmentary plan view of the novel carton blank constructed in accordance with the invention;

FIG. 4 is a plan view of the identification band having perforated margins which is employed in the sealing method;

FIG. 5 is a sectional view of the body seam of the carton shown in FIG. 1 taken along the line 5—5;

FIG. 6 is a sectional view of the body seam of the carton shown in FIG. 1 taken along the line 6—6;

DESCRIPTION OF THE PREFERRED EMBODIMENTS

Referring now to the drawings in detail, it will be seen that there is illustrated in FIGS. 1 through 7 a carton which is formed in accordance with this invention, the carton being generally referred to by the numeral 12. Carton 12 may have a decorative appearance provided by a surface treatment thereto. The surface treatment and concomitant decorative appearance make it unnecessary to further wrap the carton when the carton and its content are given as a gift. For purposes of identifying the content and source of the package to the prospective purchaser thereof, the package is provided with an identification band 13 which usually carries advertising indicia related to the content of the package. Since the package may be given as a gift, it is desirable that identification band 13 be initially a permanent part of the carton, but subject to removal after purchase so that it does not detract from the appearance of the package when it is given as a gift. Since it is required that identification band 13 be, at least initially, a permanent part of the carton, it is not merely telescoped over the erect carton and it is therefore necessary that identification band 13 be affixed to the carton blank before that blank is erected into a carton.

Referring particularly to FIGS. 2 and 3, it will be seen that there is illustrated the details of a blank, which is generally identified by the numeral 14, from which the carton 12 is formed. The carton blank 14 is preferably formed of paper board provided with a suitable decorative external coating. The manner in which carton blank 14 is decorated forms no part of this invention.

Carton blank 14 is generally rectangular in outline and the central portion thereof is provided with a plurality of fold lines 15, 16 and 17 dividing the central portion of the carton blank 14 into body panels 18, 19, 20 and 21, respectively. A pair of tabs 22 and 22' are attached to body panel 18 along respective fold lines 23 and 23'. Between tabs 22 and 22', there is defined a slot 24. A glue flap 25 is attached to body panel 21 along a fold line 26. Defined in glue flap 25 there are a tab 27 and slots 28 and 29 contiguous thereto.

Tab 27 is generally coaxially aligned with slot 24 and registers therewith in erect carton 12, while tabs 22 and 22' are generally coaxially aligned with respective slots 28 and 29 and correspondingly register respectively therewith in erect carton 12.

Carton 12 is provided with suitable closed ends and only top end 30 is illustrated. The ends of carton 12 may be formed in any desired manner, however, it is desirable for the bottom end to be permanently sealed and the top end 30 readily openable and closable for introducing or withdrawing the package content.

Conventional closure means may be employed in the construction of top end 30 and the bottom end of carton 12. For instance, the bottom end of carton 12 may be formed by providing carton blank 14 with bottom closure flaps 31, 32, 33 and 34 which are separate from one another and which are hingedly connected to respective ones of the body panels 18–21 along a transverse fold line 35.

The top end 30 of carton 12 is formed by a plurality of closure flaps 36, 37 and 38 which are separate from one another and are connected to respective ones of the body panels 19–21 along a transverse fold line 39. Details of the various closure flaps are not critical to the operation of the invention.

The carton blank 14 is in a generally flat condition when identification band 13 is adhesively sealed thereto. As best seen in FIGS. 2 and 4, identification band 13 is an elongated strip 40, for instance, a foil. Strip 40 extends transversely across body panels 18–21 of carton blank 14 and has one end 41 overlying tab 27 and slots 28 and 29 contiguous therewith. End 41 is permanently secured to tab 27 by means of a suitable adhesive 43. The other and opposed end 42 of strip 40 overlies tabs 22, 22' and slot 24 defined therebetween and is permanently secured to tabs 22 and 22' by adhesive 43. Strip 40 is of a length *d* which is coextensive with the distance between free longitudinal ends of respective tabs 27 and 22. Spaced from respective ends 41 and 42 of strip 40, respective series of perforations 44 and 45 are provided. The respective series of perforations 44 and 45 are longitudinally located in the margins of the band proximate respective ends 41 and 42 thereof. Strip 40 is secured to the blank at respective tabs 22, 22' and 27. Adhesive 43 is generously applied over the outer surface of tabs 22, 22' and 27 and opposed ends 41 and 42 of strip 40 are aligned over the respective tabs of the blank. Respective series 44 and 45 of perforations overlie respective, opposed adhesive coated tabs 22, 22' and 27. Pressure is applied to opposed margins of the strip and the strip is secured to the opposed tabs. Some adhesive coated on the respective tabs leaks through perforations 44 and 45 provided in strip 40.

In erecting the carton 12 from the banded blank 14, adhesive 43 is applied to glue flap 25 and end 41 of strip 40 including the perforated margin thereof. The exterior surface of glue flap 25 will be bonded to the interior surface of the body panel 18 and the exterior surfaces of the margins provided in respective opposed ends 41 and 42 of strip 40 are brought into face to face engagement and securement. When the body portion of the carton blank is bonded together, closure flaps 31–34 may be permanently interlocked to form the bottom end of the carton. After the product is introduced into the erect carton, closure flaps 36–38 may be folded into releasably interlocking engagement.

The strip 40 thus secured initially permanently in place, may be removed from the carton only by purposefully tearing the band 13 from the carton. The securement of band 13 to the carton is achieved by adhesively connecting ends and perforated margins of the strip 40 to the tabs provided in the carton. Band 13 is otherwise free from connecting engagement with body panels of carton 12. In the erect carton, opposed perforated margins of strip 40 are in face to face engagement and a secure substantially permanent band to band seal is achieved by providing the strip margins with respective series of perforations. In the erect carton, there is substantially a laminate formed consisting of engaged respective tabs and margins of the band. Perforations provided in margins of the band allow the adhesive to flow therethrough for providing a substantially uniform seal between substrate layers of the laminate.

According to the sealing method, the erect carton is provided with substantially permanent blank to band and band to band seals. The method may be applied to any generally rectangular gift carton, but it is particularly suited to a carton 12 erected from a particularly constructed blank 14.

It will thus be seen that the objects set forth above among those made apparent from the preceding description are efficiently attained and since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A carton erected from a carton blank comprising a generally rectangular sheet having score and cut lines therein defining a plurality of adjacent body panels having end forming flaps at opposite ends thereof, a glue flap along one of said body panels, a tab defined in said glue flap, a pair of tabs along another of said body panels, a slot in said another body panel determined by said pair of tabs, said slot being axially aligned with said tab provided in said glue flap along one of said body panels, and an identification band extending transversely across said body panels in overlying relation to said outer surface, said identification band having opposed ends and in margins located a predetermined distance from said respective opposed ends, respective series of longitudinal perforations, one of said opposed ends of said identification band being adhesively secured to said pair of tabs provided along said another body panel along said margin of said identification band, said other opposed end of said identification band being adhesively secured to said tab provided in said glue flap along one of said body panels along said margin of said identification band, said identification band being otherwise free from said body panels of said carton blank, said carton being erected from said carton blank and having a body seam at one corner thereof, said body seam including said tab provided in said glue flap along one of said body panels and said perforated margin of said identification band secured thereto, and an adhesive securing an outer face of said perforated band margin to said perforated outer face of said band margin secured to said pair of tabs along said another body panel, said tab provided in said glue flap said adhesively bonded tabs and band margins being disposed within said carton.

* * * * *